United States Patent [19]

Kraicer

[11] 3,968,807

[45] July 13, 1976

[54] WIG

[75] Inventor: John Kraicer, Brookline, Mass.

[73] Assignee: Europa Group, Inc., South Boston, Mass.

[22] Filed: Feb. 11, 1975

[21] Appl. No.: 548,897

Related U.S. Application Data

[63] Continuation-in-part of Ser. No. 512,006, Oct. 4, 1974, abandoned.

[52] U.S. Cl. ..... 132/53

[51] Int. Cl.[2] ..... A41G 3/00

[58] Field of Search ..... 132/53, 54, 9, 7

[56] References Cited

UNITED STATES PATENTS

| | | | |
|---|---|---|---|
| 1,424,845 | 8/1922 | Nolan | 132/53 |
| 3,530,862 | 9/1970 | Hudson | 132/5 |

*Primary Examiner*—G.E. McNeill

*Attorney, Agent, or Firm*—Wolf, Greenfield & Sacks

[57] ABSTRACT

A wig includes structure which provides a more natural hairline appearance by including a plurality of individual fingers which are spaced along and extend downwardly from the edge of the wig base. Hairs are attached to each of the individual fingers.

18 Claims, 9 Drawing Figures

WIG

This application is a continuation-in-part of my application Ser. No. 512,006 filed Oct. 4, 1974 now abandoned.

BACKGROUND OF THE INVENTION

It is desirable that a wig, when worn, presents as natural an appearance as possible. Among the primary difficulties encountered for some time has related to the appearance at the hairline region of the wig at the front portion at the user's forehead. While many wig constructions and techniques have been suggested to achieve a naturally appearing hairline, most of them have proved to be impractical while some have achieved varying degrees of success. In general, those wigs which have realized some success do tend to conceal or camouflage the hairline region but only if the wig is worn with the hair in a particular arrangement or configuration. When the hair configuration is changed, sometimes only slightly, the wig line or wig cap to which the hair is secured often is revealed. For example, this might occur as a result of combining or as the result of wind or due to other causes. Similar difficulties are encountered with partial wigs (e.g., toupees or hairpieces) in which it is important to avoid, as best as possible, separation lines or regions between the user's natural hair and that of the hairpiece. It is among the primary objects of the invention to provide an improved wig construction which results in a more natural hairline which is less likely to be revealed in the event that the hairline region is disturbed or rearranged.

SUMMARY OF THE INVENTION

The invention may be employed in most types of full or partial wig constructions which typically include a skull cap with wig hair attached to the skull cap in any of a variety of well known techniques. The edge of the skull cap, at its forward portion, has stitched to it a plurality of spaced, outwardly extending fingers. Each finger is surrounded by a netting or sleeve and wig hairs are attached to the netting or sleeve at selected locations.

Among the objects of the invention is to provide a wig having a more naturally appearing hairline.

A further object of the invention is to provide a wig having a more naturally appearing hairline and in which commonly encountered disturbances to the hairline region will not readily reveal the underlying support structure for the wig.

Another object of the invention is to provide an improved wig in which the hair at the hairline or peripheral regions thereof may be rearranged in a wider variety of configurations than with previous types of wigs.

A further object of the invention is to provide a wig having a plurality of fingers extending downwardly or outwardly from the edge of the wig supporting structure and having hairs secured to the fingers.

DESCRIPTION OF THE DRAWINGS

The foregoing and other objects and advantages of the invention will be understood more fully from the following further description thereof with reference to the accompanying drawings wherein.

DESCRIPTION OF THE PREFERRED EMBODIMENTS

Figure 4:
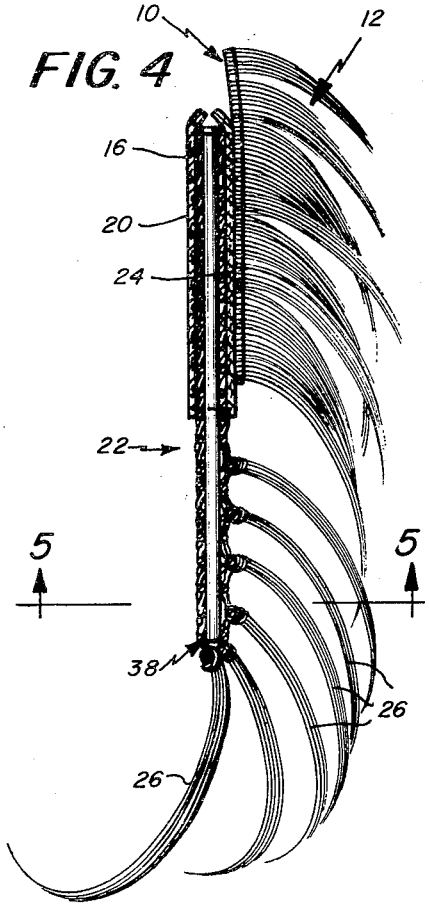
FIG. 4 is an enlarged sectional elevation of one of the hair supporting fingers at the front portion of the wig as seen along the line 4—4 of FIG. 1.

The invention may be incorporated in any typical wig construction having a wig base in the form of a skull cap 10 with the wig hairs 12 secured to the skull cap. The skull cap can be constructed in a variety of panels and configurations employing a variety of conventional webbings, nettings, fabrics or the like. Typically, the skull cap 10 includes a band, indicated generally at 14 at its lower peripheral edge to bind the edge of the skull cap 10 as well as to reinforce it. In the embodiment illustrated, the band 14 includes a front portion 16 which is intended to extend over and about the user's forehead region slightly over the natural location of the hairline. The more rearward portions 18 of the band, as shown, may be made from an elastic material to enable the skull cap 10 to be slipped over the user's head and be retained snugly but not uncomfortably in place. In this regard it may be desirable to fabricate the inwardly facing surface 20 (see FIG. 4) of the front portion 16 of the band so that it contacts the user's head with a soft, comfortable surface which does not dig into the skin.

In accordance with the invention a plurality of fingers 22 are secured to the front portion 16 of the band 14 and in spaced relation along the band. The fingers 22 may be spaced, for example, of the order of approximately at half inch intervals. The fingers 22 may be stitched integrally to the band 14 and, as shown, the band may have a front section 24 and a rear section 20 with the upper ends of the fingers 22 being disposed and stitched between the sections 20, 24 of the band.

Figure 1:
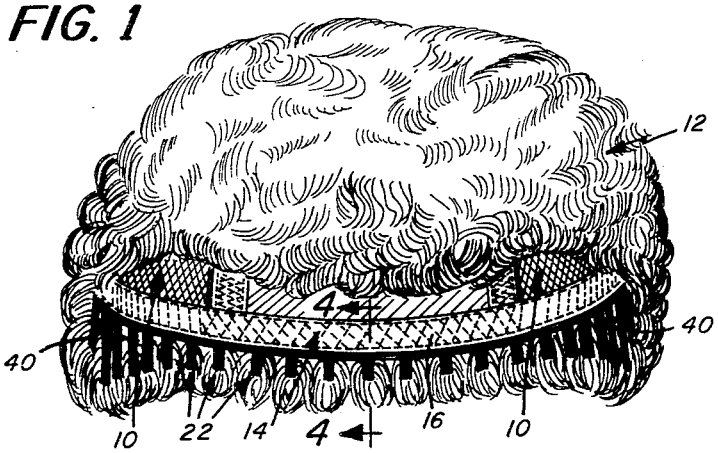
FIG. 1 is an illustration of the back side and inside of the front portion of the wig as seen from the rear of the wig and slightly from below.
Figure 2:
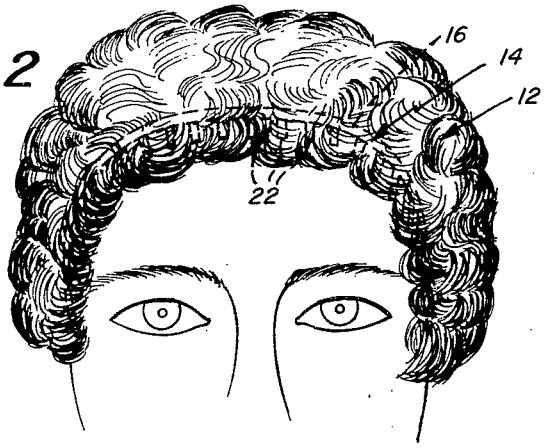
FIG. 2 is a front elevation of the wig as worn.
Figure 5:
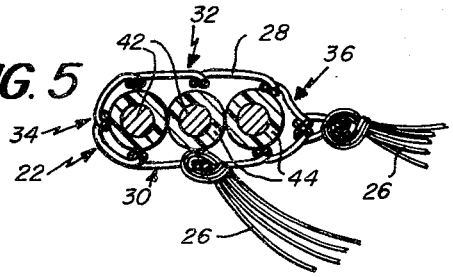
FIG. 5 is a further enlarged sectional illustration of one of the fingers as seen along the line 5—5 of FIG. 4.

The skull cap 10, band 14 and fingers 22 may all be stitched together securely by diagonal stitching as suggested in FIG. 1. A plurality of groups of hairs, each group indicated at 26 (FIGS. 4–6) are attached to the depending fingers 22. The upper wig hairs 12 which are disposed slightly above the fingers 22 may extend downwardly to merge into and mingle with the hairs 26 on the fingers and thus present a substantially continuous and naturally merged hair region.

Figure 3:
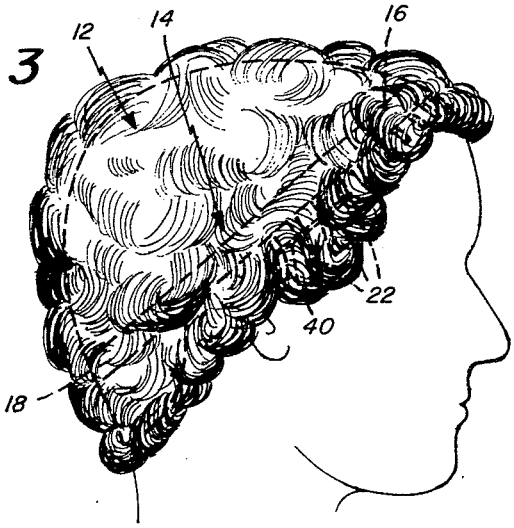
FIG. 3 is a side elevation of the wig as worn.
Figure 6:
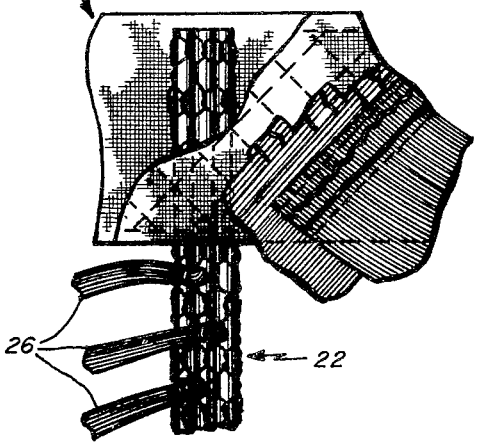
FIG. 6 is an enlarged front illustration of a portion of the frong side of the wig showing the manner in which one of the fingers is secured to the wig.

The groups of hairs 26 may be secured to the fingers by a variety of techniques. In the preferred embodiment, each of the fingers 22 is encased within a sheath 28 formed from netting which also is stitched to the band 14 together with its associated finger 22. The group of hairs 26 are attached to the sheath 28. The finger 22 and its associated sheath 28 may be considered as having a front face 30, back face 32, side edges 34, 36 and a lower end 38. The groups of hairs 26 are secured to the netting 28 of each finger 22 by conventional knotting techniques at the front face 30, along one of the side edges, as at 36, and at the lower end 38, with the greatest concentration of the hairs 26 being tied to the netting at its lower end 38. The groups of hair 26 secured to one of the edges 36 preferably are knotted at locations spaced along the length of the finger 22 and the hair groups 26 which are secured at the front face 30 of the finger also are spaced lengthwise along the finger 22. In addition, as shown in FIG. 6, the lateral spacing of the knots may be varied slightly between the hair groups 26 at the frong face 30 of the finger. It is unnecessary, in general, to secure any of the wig hairs to the back side 32 of the netting 28. The group of hairs 26 secured to the fingers 22 may be somewhat curled as suggested in the drawings so that the hairs secured to one of the fingers may span the gap between that finger and one or more of the adjacent fingers in the wig, the hairs on all of such fingers merging and being intermingled with each other and with some of the base hairs 12 to provide a natural hair-like appearance. It may be noted that the fingers 22 in the more central, front portion of the wig are shorter than those at the more lateral regions of the wig near the wearer's ears. The lengths of the fingers is in large part a matter of styling preference. In the illustrated embodiment the somewhat elongated fingers at the side of the wig are intended to provide an appearance in which the hair on the sides extends downwardly to cover a substantial portion of the region just in front of and overlapping part of the user's ears. In addition, it may be noted that the most lateral group of fingers 22 may be interconnected with each other as by an elastic thread 40 (see FIGS. 1 and 3) stitched to each of the more elongated fingers.

The fingers 22 may be fabricated so that their individual attitudes can be varied somewhat. To this end, each of the fingers 22 may include a core structure which is made from a deformable material. As shown most clearly in FIG. 5 the core structure of the fingers enables each of the fingers to be bent, twisted or otherwise manipulated to vary the attitude and configuration of the hairs which are secured to the fingers 22. In this manner, the fingers 22 may be rearranged to enable the user to rearrange the hair in that region to a desired hair style.

By employing the foregoing construction of projecting fingers with hairs secured thereto it will be understood that there is relatively little supporting structure in the region of the hairline which might tend to be exposed. The only structure is that of the fingers themselves which are well camouflaged by the intermingled hairs. Should it be desired to spread some of the hairs, as to define the front of a parting line, that may be done by bending a pair of fingers away from each other exposing perhaps only a portion of the user's forehead but not any significant underlying supporting structure. Moreover, should a region of the hair at the front portion of the wig become separated by a combing, wind or the like, it will tend to do so between the fingers. It may be noted further that the foregoing structure may be embodied in a wig in which the user's natural hairline is slightly exposed below the bottom of the front portion 16 of the band 14. In this event, even an extreme separation of a pair of fingers will reveal only a natural hair line and not any of the supporting structure for the wig.

Figure 7:
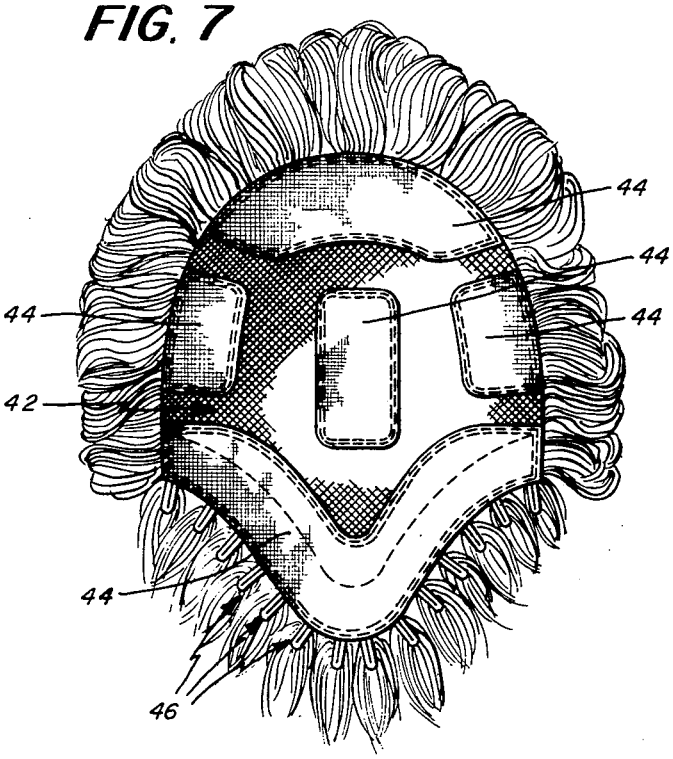
FIG. 7 is an illustration of the underside of a partial wig or toupee.

FIG. 7 shows a manner in which the invention may be incorporated into a partial wig such as a toupee. The basic structure of the toupee typically will include a skull cap 42 which may be made from suitable mesh material. The skull cap may be reinforced at selected locations by lining elements suggested at 44 which may be stitched to the mesh skull cap 42 in a variety of locations including the margins of the cap 42. In order to provide a multiplicity of hairs at the peripheral region of the hairpiece and in a manner which will minimize an appearence of a flase hairline or the underlying supporting structure for the hairpiece, fingers such as those described in regard to the previous embodiment or those shown in FIGS. 7–9 may be employed. The fingers, indicated at 46 in FIGS. 7–9, may also take the form shown which includes a deformable wire 48 bent into a U-shaped configuration. The wire preferably is encased within a plastic or similar sleeve 50 and the sleeve 50 is surrounded by a mesh or net sheath 52 to which the hairs 54 may be attached. The hairs 54 are attached by suitable knots 56 and are disposed so that the hairs will lie on the exterior of the hairpiece to cover the fingers 46 and to merge and mingle with the hairs attached to the skull cap 42 as well as with the user's natural hairs. It may be noted that in the embodiment shown in FIG. 7 the fingers 46 are secured only to the forwardmost edge of the hairpiece. It should be understood, however, that depending on the particular style of hairpiece and the user's natural hair, the fingers may also be located at other peripheral regions of the skull cap.

Figure 8:
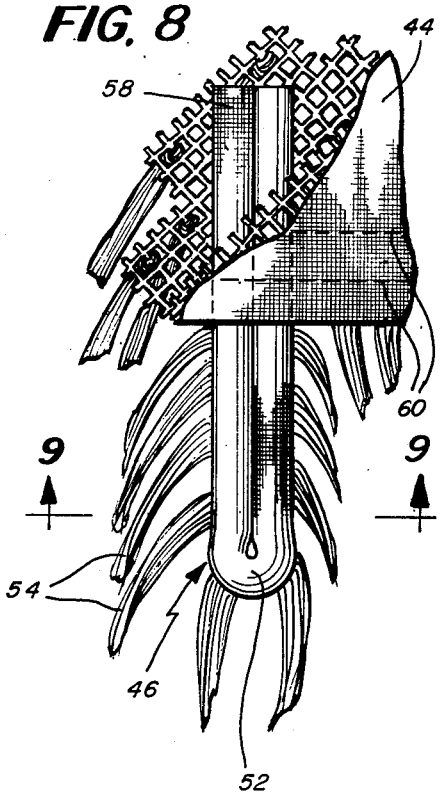
FIG. 8 is an enlarged illustration of a modified embodiment of the hair supporting fingers as may be employed with the toupee shown in FIG. 7.
Figure 9:
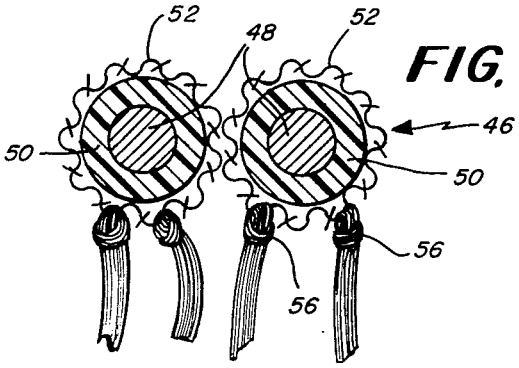
FIG. 9 is a sectional illustration of the hair supporting fingers of FIG. 8 as seen along the line 9—9 of FIG. 8.

FIG. 8 shows the manner in which the flexible, deformable fingers 46 may be secured to the skull cap shown in FIG. 7. The inwardly disposed, opposite ends 58 of the fingers may be located between the mesh portion of the skull cap 42 and the liner portion 44, the finger 46, skull cap 42 and liner 44 being stitched together as suggested by the stitch lines 60.

It should be understood that the foregoing description of the invention is intended merely to be illustrative thereof and that other modifications and embodiments may be apparent to those skilled in the art without departing from its spirit.

Having thus described the invention what I desire to claim and secure by Letters Patent is:

1. A wig comprising:
a base structure having an edge portion;
a multiplicity of hairs secured to said base portion;
a plurality of fingers secured to the lower edge of said base portion in spaced relation therealong, said fingers extending generally downwardly therefrom; and
a plurality of hairs attached to each of said fingers.

2. A wig as defined in claim 1 where said hairs attached to each of said fingers are arranged in groups, each group comprising a plurality of hairs, said groups being attached to each of said fingers at spaced locations thereon.

3. A wig as defined in claim 1 further comprising:
each of said fingers being surrounded by a sheath, said plurality of hairs being attached to said sheath.

4. A wig as defined in claim 1 wherein some of said fingers are longer than other of said fingers.

5. A wig as defined in claim 1 further comprising:
at least some of the hairs secured to said wig base being sufficiently long and being arranged so that they may extend generally downwardly into intermingling relationship with at least some of the hairs attached to said fingers.

6. A wig as defined in claim 1 wherein some of said fingers are interconnected with other of said fingers.

7. A wig as defined in claim 1 wherein said fingers are of somewhat flatened configuration having a front face, a rear face, side edges and an outer end;

said pluralities of hairs being secured at least to the front face and outer end of said fingers.

8. A wig as defined in claim 7 further comprising:

some of said plurality of hairs also being attached to at least one of the edges of said fingers.

9. A wig as defined in claim 7 wherein said rear face of said fingers are free of any hairs.

10. A wig comprising:

a base structure having an edge portion;

a multiplicity of hairs secured to the base portion;

a plurality of fingers secured to at least a portion of the peripheral edge of the base portion in spaced relation therealong, the fingers extending generally outwardly from the edge of the base portion;

a plurality of hairs attached to each of the fingers; and the fingers being formed from a deformable material to enable them and the hairs carried thereby to be arranged in various configurations.

11. A wig as defined in claim 10 wherein the deformable fingers are formed by means comprising:

a plurality of deformable wires extending generally parallel to each other;

the wires being surrounded and bound together by a netted sheath; and the hairs being secured in individual groups thereof to the sheath at spaced locations on the sheath.

12. A wig as defined in claim 10 wherein the deformable fingers further comprise:

a plurality of deformable wires;

a netted sheath surrounding each of the wires, each of the sheathed wires being bent into a U-shaped configuration, each of the bent wires being secured to and extending from the edge of the base structure with its bight at its outermost end; and the hairs being secured to the netted sheath at spaced locations thereon.

13. A wig comprising:

a base structure having a peripheral edge with a portion of the edge adapted to be positioned over the wearer's forehead;

hair-like fibers extending from the surface of the base structure;

a plurality of spaced projections extending from said portion of the edge, the projections being adapted to extend over at least a portion of the wearer's forehead; and additional hair-like fibers extending from each of said projections.

14. A wig as set forth in claim 13 wherein said additional fibers extend at least in part from the outer end of said projections.

15. A wig as set forth in claim 14 wherein the surfaces of said projections that normally face the wearer's forehead are essentially devoid of said additional fibers.

16. A wig comprising:

a base structure having a peripheral edge with a portion of the edge adapted to be positioned over a wearer's forehead;

hair-like fibers extending from the surface of the base structure;

a plurality of spaced projections extending from said portion of the edge and forming fingers adapted to extend across at least a portion of the wearer's forehead;

additional hair-like fibers extending from each of said projections; and means interconnecting a plurality of said projections at locations intermediate their ends.

17. A wig as set forth in claim 16 wherein said interconnecting means comprises stitching that interengages a plurality of adjacent of said projections.

18. In a wig having a base structure, the improvement comprising a plurality of projections connected to the base structure and extending away from the edge of the base structure and a plurality of hair-like fibers extending from each of the projections.

* * * * *